United States Patent [19]

Weir

[11] Patent Number: 4,779,509

[45] Date of Patent: Oct. 25, 1988

[54] MAGNETIC PERCUSSION SUSPENSION

[76] Inventor: Robert F. Weir, 58 Manzanita, Los Gatos, Calif. 95030

[21] Appl. No.: 110,187

[22] Filed: Oct. 19, 1987

[51] Int. Cl.[4] ..... G10G 5/00

[52] U.S. Cl. ..... 84/421; 84/411 R

[58] Field of Search ..... 84/411 R, 421

[56] References Cited

U.S. PATENT DOCUMENTS

| | | | |
|---|---|---|---|
| 3,780,613 | 12/1973 | Ludwig | 84/421 |
| 4,244,267 | 1/1981 | Nemeth | 84/418 |
| 4,252,047 | 2/1981 | Gauger | 84/421 |
| 4,271,745 | 6/1981 | Shatto | 84/402 |

FOREIGN PATENT DOCUMENTS

| | | | |
|---|---|---|---|
| 271396 | 10/1950 | Switzerland | 84/411 R |

*Primary Examiner*—Lawrence R. Franklin
*Attorney, Agent, or Firm*—Stanley M. Weir

[57] ABSTRACT

A drum or other percussion instrument is held suspended in air by magnetic force fields which allows sound vibrations to radiate from the instrument uninhibited by direct contact of the instrument with a support structure. Magnetic force is provided by permanent magnets or electromagnets. A first set of magnets is connected to a percussion instrument and a second set of magnets is connected to the framework of a support structure. Poles of the first set of magnets face like poles of the second set of magnets. Magnetic repulsion suspends the instrument on a cushion of magnetic force and contains the instrument from moving off the cushion of magnetic force.

6 Claims, 4 Drawing Sheets

FIG_13
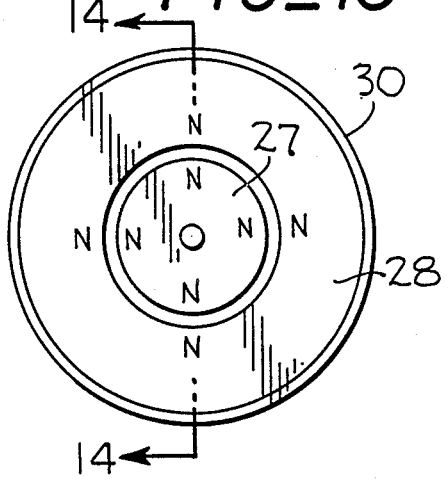
FIG_14
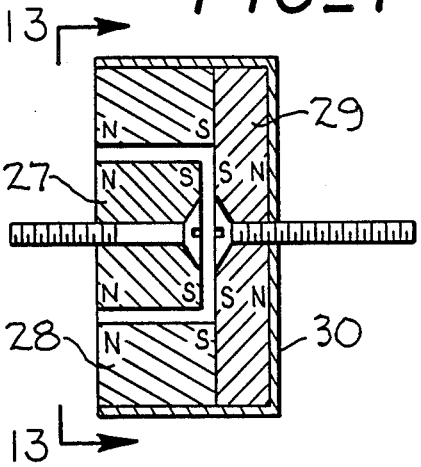
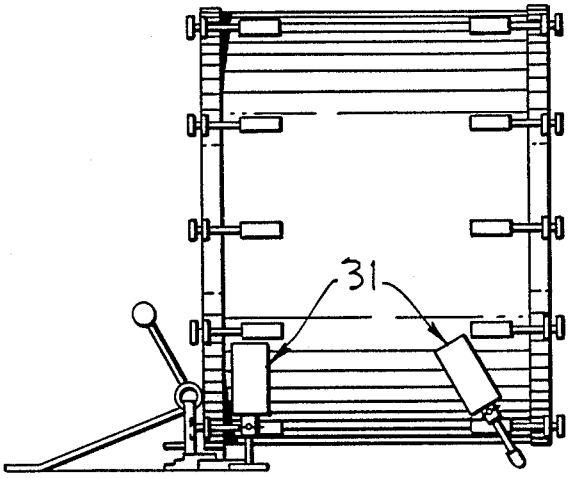
FIG_15
FIG_16
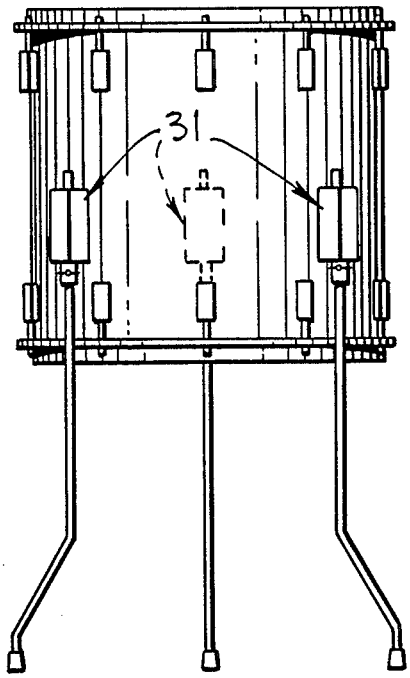

MAGNETIC PERCUSSION SUSPENSION

BACKGROUND

The advantage of having a drum actually suspended in air on a cushion of magnetic force is that the drum heads and shell are allowed to resonate as completely as physically possible. A drum is allowed to give off its full tonal range with more overtones and undertones, which gives the drum its natural fuller, deeper and louder sound.

One object of importance is to use a minimum of magnetic force to accomplish suspension.

Another object of importance is to suspend a drum on cushions of magnetic force at whatever degree of inclination it is desired for the drum to be held in.

Still another object of importance is to provide a simplicity of construction.

The above and other advantages of the present invention will no doubt become apparent after reading the following detailed description of the preferred embodiments which are illustrated in the figures of the drawing.

IN THE DRAWING

FIG. 13 is an end cross section view taken along line 13—13 of FIG. 14 showing details of a fourth species of magnetic percussion suspension wherein permanent magnets are used and the drum is supported by a group of six like cooperating magnetic suspension devices.

FIG. 14 is a side elevation view taken along line 14—14 of FIG. 13.

FIG. 15 shows a base drum mounted on magnetic suspension devices.

FIG. 16 shows a floor stand supported tom tom drum mounted on magnetic suspension devices.

DESCRIPTION OF THE PREFERRED EMBODIMENTS

The present invention has many species several of which are illustrated and described in order to illuminate basic principles of the invention.

Figure 1:
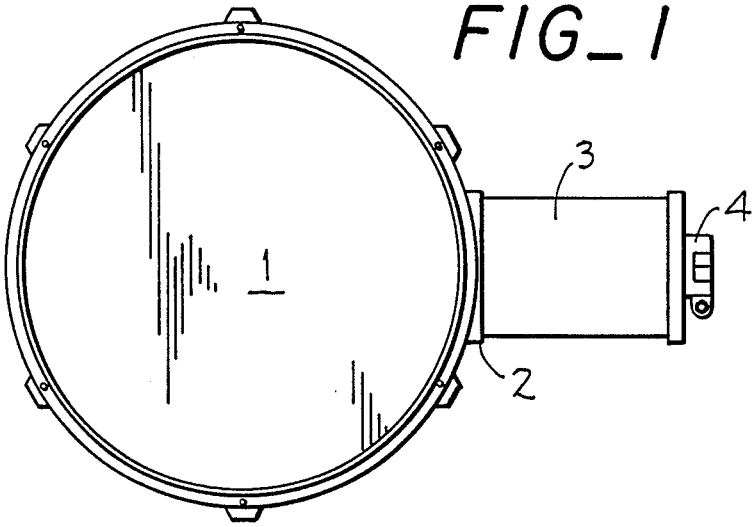
FIG. 1 is a top view of a drum suspended by a single magnetic suspension arm.
Figure 2:
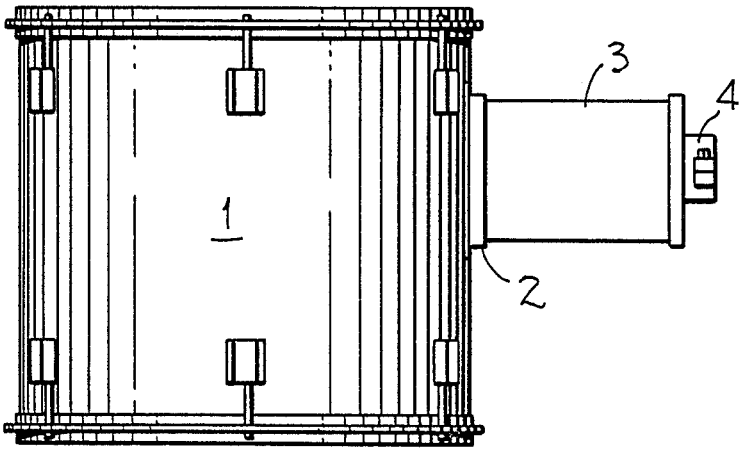
FIG. 2 is a side elevation view of the drum and suspension shown in FIG. 1.

FIGS. 1 and 2 illustrate a drum 1 connected to the housing 2 of a single arm magnetic percussion suspension device 3. The core 4 of the magnetic suspension arm 3 is connected to a drum support arm (not shown) which is commonly secured to a bass drum or to a floor drum stand. The drum support arm can be adjusted to place the drum in a desired position of reach and inclination.

Figure 3:
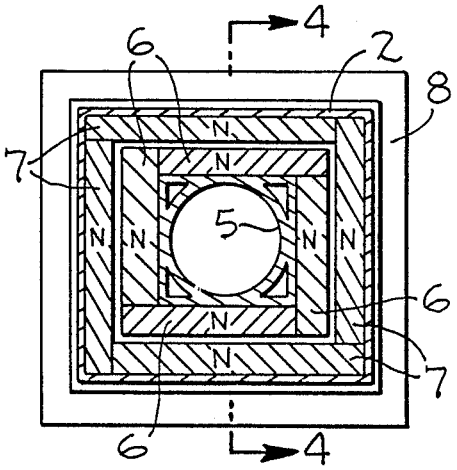
FIG. 3 is an end cross section view taken along line 3—3 of FIG. 4 showing details of a first species of magnetic percussion suspension wherein permanent magnets are used and the drum is supported by a single magnetic suspension arm.
Figure 4:
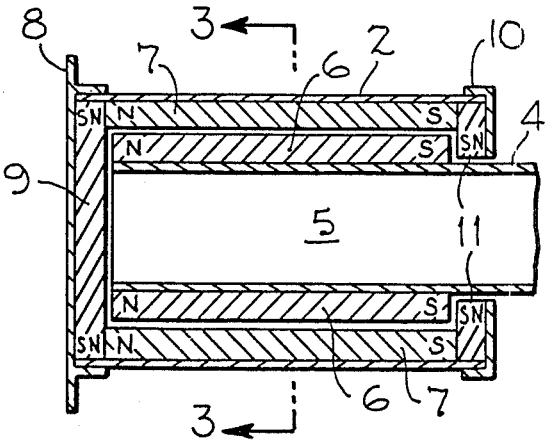
FIG. 4 is a side elevation cross section view taken along line 4—4 of FIG. 3.

FIGS. 3 and 4 show a first species of the present invention. A core tube 5 has a square outer surface and a round inner surface. The round core tube slips over and clamps onto an adjustable drum arm. To the outer square surface of the core tube 5 are secured four rectangular bar core permanent magnets 6 whose magnetic poles are oriented as shown.

Secured to the four inner surfaces of square tube housing 2 are four housing magnets 7. Like poles of magnets 6 and 7 are opposite each other and therefore are in a state of magnetic repulsion.

Secured to the inside of square left end-cap 8 is a square end-cap magnet 9 (FIG. 4). Secured to the inside of square right end-cap 10 are four end-cap bar magnets 11. Cap 10 has a round hole through it.

Poles of cap magnets 9 and 11 face like poles of the core magnets 6 and therefore are in a state of magnetic repulsion. It is noted that the core magnets are magnetically repulsed in every direction by the housing and cap magnets. The housing and cap magnets are suspended on cushions of magnetic force and contained on these cushions from moving far in any direction from the core magnets.

Figure 5:
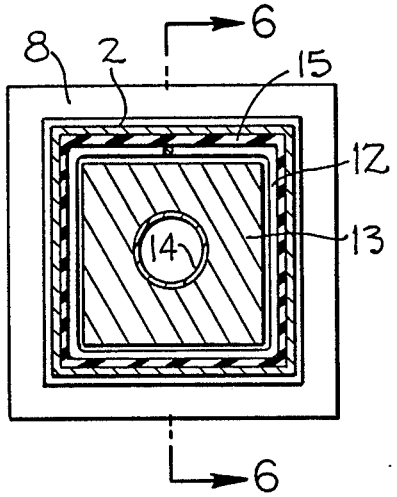
FIG. 5 is an end cross section view taken along line 5—5 of FIG. 6 showing details of a second species of magnetic percussion suspension wherein an electromagnet is used and the drum is supported by a single magnetic suspension arm.
Figure 6:
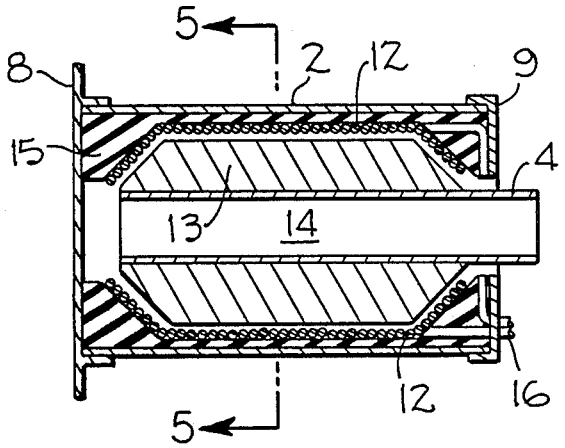
FIG. 6 is a side elevation cross section view taken along line 6—6 of FIG. 5.

FIGS. 5 and 6 illustrate a single arm magnetic percussion suspension device wherein suspension is provided by an electromagnet 12 which has a solid core 13 of high permeable iron. The iron core 13 is a square bar with tapered ends. It has a hole through it. Core 13 is secured to core tube 14 which in turn is secured to an adjustable drum support arm (not shown).

Coil turns of the electromagnet 12 parallel the shape of the iron core 13. Electromagnet 12 is secured to insulation 15 which in turn is secured to square housing tube 2. Left and right end caps 8 and 9 are the same as described above.

When the electromagnet is connected to a DC power supply, it magnetizes iron core 13 such that like poles of the core and electromagnet magnetically repulse each other in every direction. The electromagnet is suspended on a cushion of magnetic force and magnetically contained from moving very far in any direction. It is noted that movement in the direction of rotation of housing about core is contained by the square shape of core surrounded by the square housing.

Obviously, the orientation of the electromagnet and permeable core can be reversed without altering the operation, thereby making the electromagnet internal to a housing of permeable material.

Figure 7:
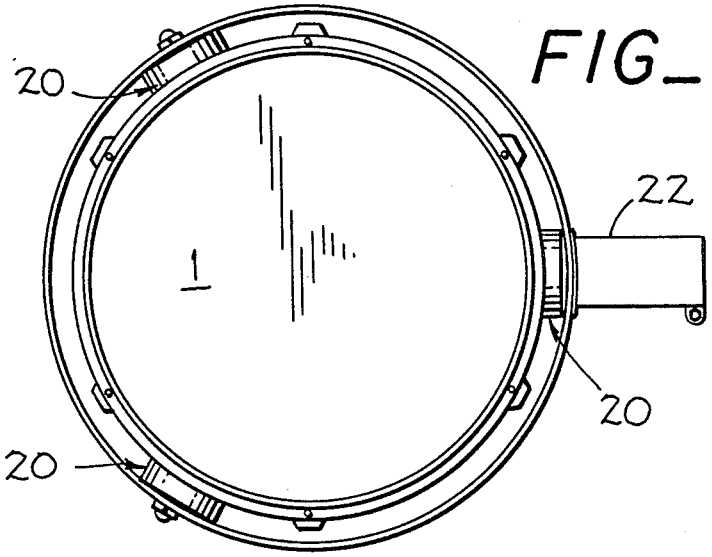
FIG. 7 is a top view of a drum suspended by a third species of magnetic percussion suspension wherein the drum is suspended by a group of three like cooperating magnetic suspension devices.
Figure 8:
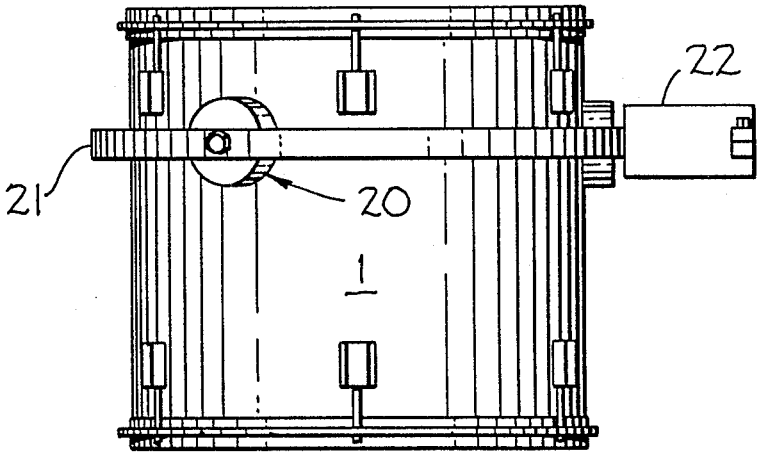
FIG. 8 is a side elevation view of the drum and suspension shown in FIG. 7.

In FIGS. 7 and 8, a drum 1 is magnetically suspended by a group of three cooperating magnetic suspension devices 20. The cores of the magnetic suspension devices are mounted on ring band 21 which is secured to a single adjustable support arm 22. Housings of the magnetic suspension devices are mounted on the drum.

Figure 9:
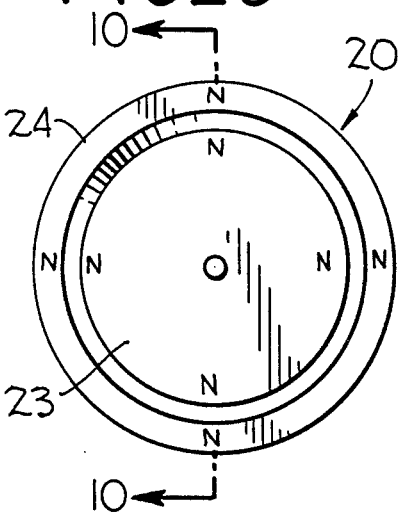
FIG. 9 is an end cross section view taken along line 9—9 of FIG. 10 showing details of a third species of magnetic percussion suspension wherein permanent magnets are used and the drum is supported by a group of three like cooperating magnetic suspension devices.
Figure 10:
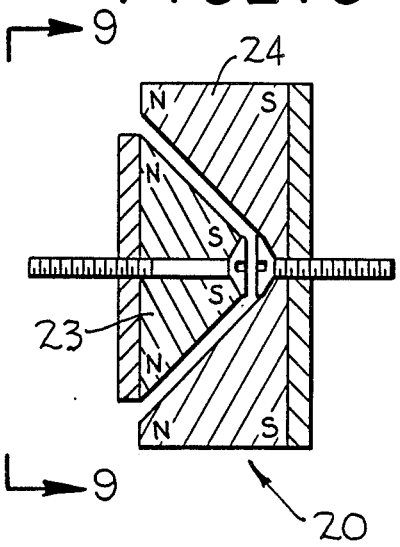
FIG. 10 is a side elevation view taken along line 10—10 of FIG. 9.

FIGS. 9 and 10 illustrate one species of group cooperative magnetic suspension devices. The permanent magnet core is conical shaped with a hole through its center through which a bolt passes which secures the core 23 to the ring band 21. The housing 24 is conical concave and has a bolt through its center whch secures it to drum 1. Orientation of magnet poles is as shown. Like poles are opposite each other and therefore the core 23 and housing 24 are in a state of magnetic repulsion. Ring band 21 holds cores 23 in position such that gaps between opposing cores 23 and housings 24 are small. The drum is thereby held in a state of magnetic suspension and contained in every direction from moving off magnetic suspension forces.

Figure 11:
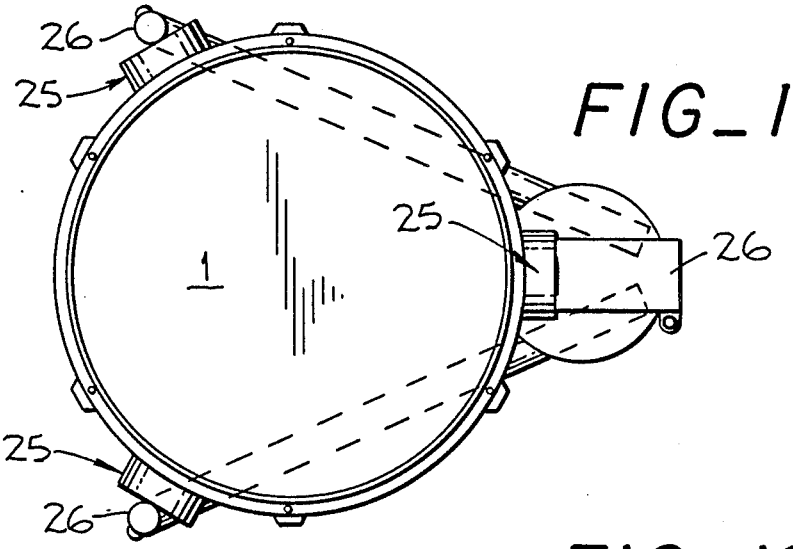
FIG. 11 is a top view of a drum suspended by a fourth species of magnetic percussion suspension wherein the drum is supported by a group of six cooperating magnetic suspension devices.
Figure 12:
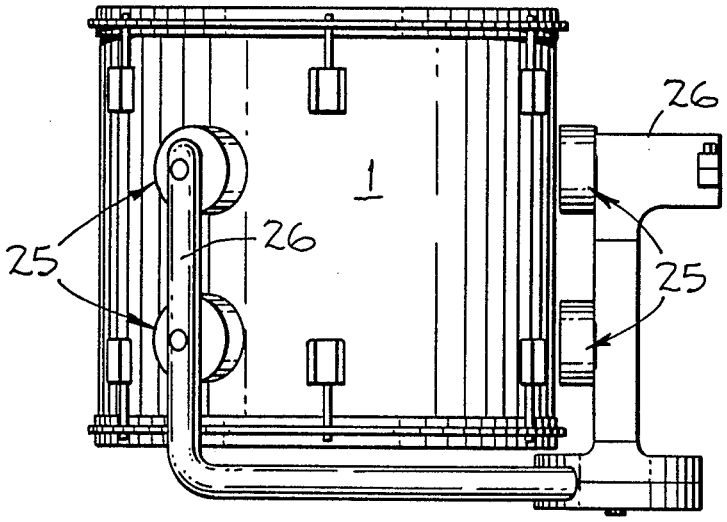
FIG. 12 is a side elevation view of the drum and suspension shown in FIG. 11.

In FIGS. 11 and 12, a drum 1 is magnetically suspended by a second species of a group of six cooperative magnetic suspension devices 25. The cores of the magnetic suspension devices are mounted on three drum adjustable support arms 26.

In FIGS. 13 and 14, details of the second species of group cooperative magnetic suspension devices is illustrated. The permanent magnet core 27 is a ring shaped round bar magnet. A bolt through its center secures it to a drum support arm 26. The housing is comprised of two ring permanent magnets 28 and 29 which are secured to a housing cap 30. A bolt passes through ring magnet 29 and cap 30 and fastens the housing to the drum. Orientation of poles of the magnets 27–29 is as shown in FIGS. 13 and 14. Like poles are opposite each other and therefore the core and housing are in a state of magnetic repulsion. Support arms 26 hold cores 27 in position such that gaps between opposing cores 27 and housing magnets 28–29 are small. The drum 1 is thereby held in a state of magnetic suspension and contained in every direction from moving off the magnetic force fields.

FIG. 15 illustrates the mounting of a bass drum on magnetic suspension devices 31 which may be constructed according to any one of the above described species.

FIG. 16 illustrates the mounting of a floor tom tom drum on magnetic suspension devices which devices also may be constructed in accordance with any one of the above described species.

When a blow is struck on a drum supported by magnetic suspension, one or more gaps between opposing core and housing magnetic fields first narrows then returns to the original gap width when the blow ceases. The amount of "flex" (change in gap width due to blow on drum) can be designed into the magnetic susepension device by reducing opposing flux to get greater flex and vice versa. When electromagnets are used, flex can be controlled by increasing or decreasing current supplied to the electromagnets. Opposing flux must, of coure, be sufficient at a minimum to suspend the weight of a drum on opposing magnetic force fields.

It is believed apparent that the invention is not necessarily limited to the specific constructions illustrated and described, since such constructions are only intended to be illustrative of the principles of operation, it being considered that the invention comprehends any variations covered by basic principles disclosed.

What is claimed is:

1. A percussion instrument magnetic suspension device comprising:

first magnet means connected to a percussion instrument;

second magnet means connected to a support structure;

wherein like poles of the first and second magnet means oppose one another; and the arrangement of magnet poles wherein magnetic fields of the first magnet means oppose movement of the second magnet means in every direction.

2. The apparatus of claim 1 wherein a first species of magnetic percussion suspension is comprised of:

an elongated square core magnet connected to a drum support arm;

an elongated square tubular housing magnet whose inner dimensions are greater than the outer dimensions of the core magnet;

a square housing end-cap magnet;

a square ring housing end-cap magnet;

means for encasing the housing magnets;

orientation of poles of core and housing magnets such that like poles of core magnets and housing magnets are opposite each other.

3. The apparatus of claim 1 wherein a second species of magnetic percussion suspension is comprised of:

a core of high permeable material connected to a drum support arm wherein the core cross section is square and whose end surfaces are tapered;

a square electromagnetic whose inner dimensions are greater than the outer dimensions of the core and whose inner surfaces parallel the surfaces of the core;

a direct current power supply connected to the electromagnet.

4. The apparatus of claim 3 wherein the positions and dimensions of the electromagnet and permeable core are reversed making the electromagnet internal to a housing of permeable material.

5. The apparatus of claim 1 wherein a third species of magnetic percussion suspension is comprised of:

a first group of conical permanent magnets connected to a ring band supported by drum support structure;

a second group of conical concave permanet magnets connected to a drum;

orientation of poles of conical and concave conical magnets such that like poles of the magnets are opposite each other.

6. The apparatus of claim 1 wherein a fourth species of magnetic percussion suspension is comprised of:

a first group of core ring permanent magnets connected to a drum support structure;

a second group of housing permanent magnets connected to a drum, each housing comprised of two magnets wherein one magnet is a ring magnet whose inside diameter is greater than the outside diameter of a core magnet and whose other part caps one end of the ring magnet;

orientation of poles of core and housing magnets such that like poles are opposite each other

* * * * *